US005547426A

United States Patent [19]

Wood

[11] Patent Number: 5,547,426

[45] Date of Patent: Aug. 20, 1996

[54] PROGRESSIVE GOLF CLUB HAVING A DIAGONALLY BALANCED SLOT BACK

[75] Inventor: Donald C. Wood, Carlsbad, Calif.

[73] Assignee: Plop Golf Company, San Diego, Calif.

[21] Appl. No.: 574,320

[22] Filed: Dec. 18, 1995

[51] Int. Cl.[6] ..... A63B 53/04

[52] U.S. Cl. ..... 473/290; 473/349; 473/350; 473/291; 473/327

[58] Field of Search ..... 473/282, 287, 473/288, 289, 290, 291, 324, 334, 341, 345, 349, 350, 330, 317

[56] References Cited

U.S. PATENT DOCUMENTS

| | | |
|---|---|---|
| D. 163,961 | 7/1951 | Penna . |
| 3,059,926 | 10/1962 | Johnstone . |
| 3,722,887 | 3/1973 | Cochran . |
| 3,858,886 | 1/1975 | Cosby . |
| 4,420,156 | 12/1983 | Campau . |
| 4,715,601 | 12/1987 | Lamanna . |
| 4,900,028 | 2/1990 | Antonious . |
| 5,074,563 | 12/1991 | Gorman . |
| 5,224,705 | 7/1993 | Scheie . |
| 5,344,150 | 6/1994 | Schmidt . |
| 5,356,138 | 10/1994 | Chen . |
| 5,435,559 | 7/1995 | Swisshelm . |

*Primary Examiner*—Sebastiano Passaniti

*Attorney, Agent, or Firm*—John R. Duncan; Frank D. Gilliam

[57] ABSTRACT

An improved golf club head and set of clubs using progressively sized heads. The club head, of the sort generally referred to as "irons" has the usual striking and opposed back faces, an upper edge, a sole, a heel adjacent to the hosel and a toe opposite the heel. A slot of selected depth is provided across the back, extending diagonally from the upper heel area to the lower toe portion, so as to provide a thin central region and two thicker regions at the intersection of toe and upper edge and at the intersection of heel and sole. The resulting head has a diagonal balance along a line extending along the major axis of the normal elliptical pattern of ball impacts against the striking face, which results in a larger and more desirably oriented "sweet spot". The clubs in a set of irons may have progressive top edge thicknesses so that all top edges appear to have the same width in use, progressively increasing sole width from long to short irons to provide optimum ground friction characteristics and progressively increasing heel to toe lengths going from short to long irons. The hosel typically has an airfoil shaped cross section with the sharp trailing edge extending perpendicular to the intended direction of ball flight.

20 Claims, 4 Drawing Sheets

PROGRESSIVE GOLF CLUB HAVING A DIAGONALLY BALANCED SLOT BACK

BACKGROUND OF THE INVENTION

This invention relates in general to the configuration of golf clubs and, more specifically, to golf club heads having progressive sizing, a slot or channel back to diagonally balance the club head and other features to aid a golfer in properly striking the ball.

A very wide variety of golf clubs have been designed over the years. Many different shaft and head materials have been used. Heads, both for blade-like "irons" and rounded head "woods" have a great many different configurations. Both "irons" and "woods" are often made from metal today.

As club design continues to improve, improved club aerodynamics through the swing becomes more important. Air flow distortions around the club head, hosel and shaft such as can occur due to turbulent air flow can reduce club head stability during a swing.

In the past, the heads of irons and woods have been made with opposite size progressions. Woods have heads that get smaller as the clubs get shorter. Irons, on the other hand, have had heads that become smaller as the clubs get longer. It was felt that in order to obtain uniform swing weights, the longer clubs must be the lightest. The easiest way to accomplish this was to reduce head size as the clubs became longer. However, the small head, longer clubs are the most difficult to hit correctly. Improving the ease of hitting the long irons would greatly improve an average golfer's game.

Optimizing club head balance is also of great importance. Early irons had flat backs or "muscle" backs. Today, these backs have been replaced by perimeter weighted or cavity backs. This is intended to increase the size of the "sweet spot", the area on the club face over which a correct shot can be hit. Such clubs still have difficulties with poor flight paths resulting twist when the ball is hit toward the heel or toe of the club face. The golf ball dispersion pattern on the face of a club (golf ball footprint over a number of shots) is always shaped like an egg that extends from the low heel to high toe. Increasing the size of the sweet spot and reducing this twist inducing tilt is very important to achieving consistently straight shots.

A "forgiving" club is one that will produce good shots even when the ball is hit off of the sweet spot center or its center of percussion and which will eliminate shot defects caused by head twist and energy losses in its inertia, and will produce consistent results.

Thus, there is a continuing need for improvements in golf clubs which reduce airflow turbulence during a swing, increase the sweet spot size and reduce the deleterious affects of twist, and improve the progression of club head size, apparent top line thickness and sole thickness to provide forgiving clubs, each of which is optimized for specific shots.

SUMMARY OF THE INVENTION

The above-noted problems, and others, are overcome in accordance with this invention, by a set of golf irons that have several different features that make each club capable of performing its function in a progressive manner from shorter, more highly lofted, clubs to longer, less lofted clubs. The club heads have a hosel for receiving a golf club shaft and a generally blade-like portion extending from the hosel.

A slot of selected depth is provide across the back of each iron, extending from high at the heel to low at the toe, so that mass is concentrated high at the toe and low at the heel. This diagonal balance on the longest axis of the club face reshapes and expands the sweet spot to the area of the club face where most shots are hit, namely an egg shaped area lying along that diagonal. Twist caused by impact with a golf ball is essentially eliminated. This arrangement is found to produce straighter shots, especially where the ball is struck off of the club face center. The floor of the slot is preferably flat or approximately flat, with walls extending between the thin floor region and the thicker upper toe and lower heel regions lying at an angle to the floor of from about 90° to 110°.

The uniformity and stability of a swing can be further improved by reducing turbulence during the downswing. Turbulence can be significantly reduced by shaping the hosel in an airfoil or teardrop shaped cross section, with a sharp edge extending generally in line with the iron face. The result is smooth, laminar air flow around the hosel during the swing, producing less drag and a smoother swing path during critical parts of the swing.

In order to produce a uniform swing with irons of different lengths, the length of the club head from the middle of the hosel to the tip of the to gets progressively longer as the club number becomes lower, the club becomes longer and the loft becomes less. Longer clubs produce larger swings, which allow the club head to get out of the optimum plane more easily. The negative effect of the resulting less-than-solid shots is reduced by the longer blade length which has a larger sweet spot.

For optimum results, the top line thickness should appear the same for all irons to the golfer, to aid in uniformly addressing the ball. The top edge of an iron is ordinarily perpendicular to the club face, or at least at a uniform angle to the club face throughout the set of clubs. In order to provide the appearance of uniform top edge width, a progressively thinner top line is required as the clubs get longer and the loft decreases. For example, from the point of view of the golfer, a thinner top line on a 3 iron will, because the loft is less, appear to be the same thickness as the thicker top line of a wedge which has more loft, since the top edge is laying over more and not as much of the top line can be seen by the golfer at the address position.

A progressive sole thickness along the line of intended ball flight from a narrow sole on low number, low loft, irons such as a 2 iron to a wider sole on high number, high loft, irons such as a 9 iron is highly desirable. With a 2 iron, which is difficult to hit correctly, the narrow sole will desirably concentrate ground friction and permit a proper divot to be more easily taken. On the other hand, high number irons should have a wider sole so as to disperse ground friction in a way that prevents the club from digging into the ground.

Also, for optimum performance the pattern of grooves or roughened area on the club face should be increasing in length as the club number get lower and the heads become longer. The disparity in lengths defines the relative size of the effective hitting areas as it gets larger as the clubs get longer.

BRIEF DESCRIPTION OF THE DRAWING

Details of the invention, and of certain preferred embodiments thereof, will be further understood upon reference to the drawing, wherein.

DETAILED DESCRIPTION OF PREFERRED EMBODIMENTS

Figure 1:
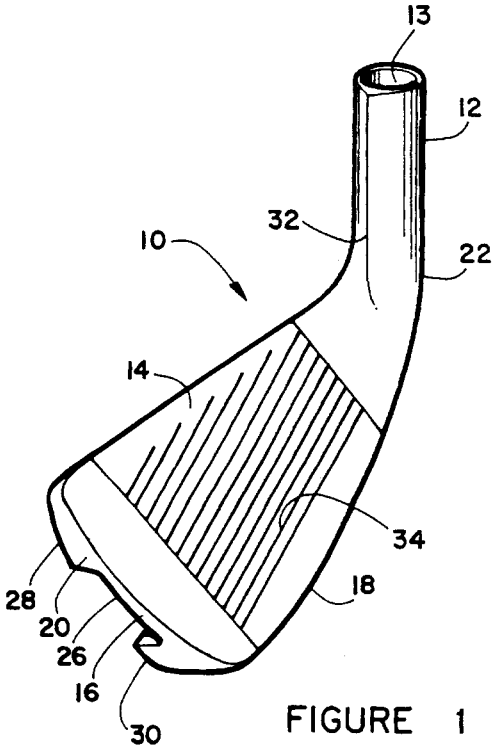
FIG. 1 is a side perspective view of a golf club head shaped in accordance with this invention.
Figure 2:
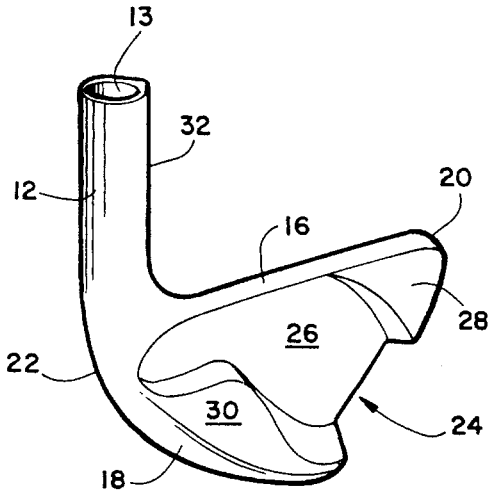
FIG. 2 is a back perspective view of the club head of FIG. 1.
Figure 3:
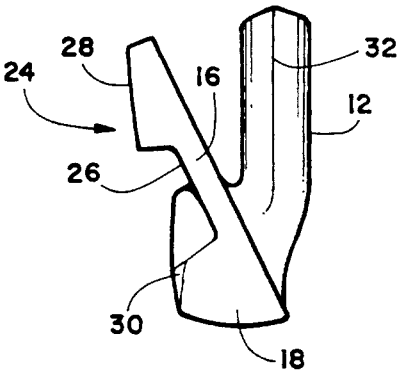
FIG. 3 is an elevation view of the club head of FIG. 1 taken from the toe end.
Figure 4:
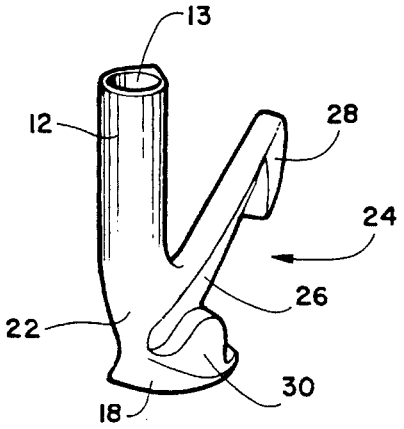
FIG. 4 is an elevation view of the club head of FIG. 1 taken from the heel end.
Figure 5:
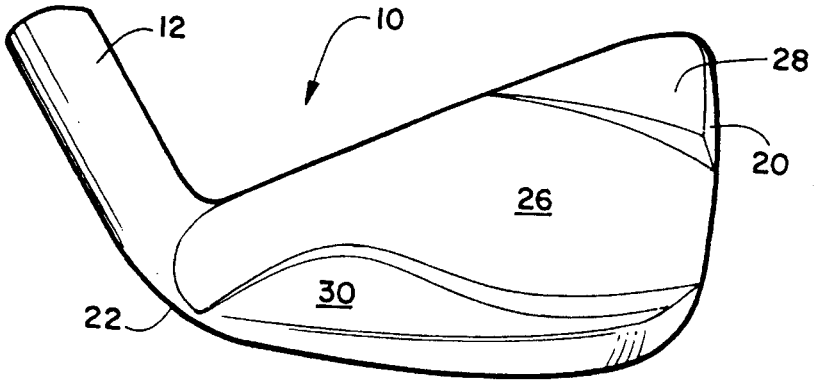
FIG. 5 is a view of the back of a 2 iron, taken normal to the back.
Figure 6:
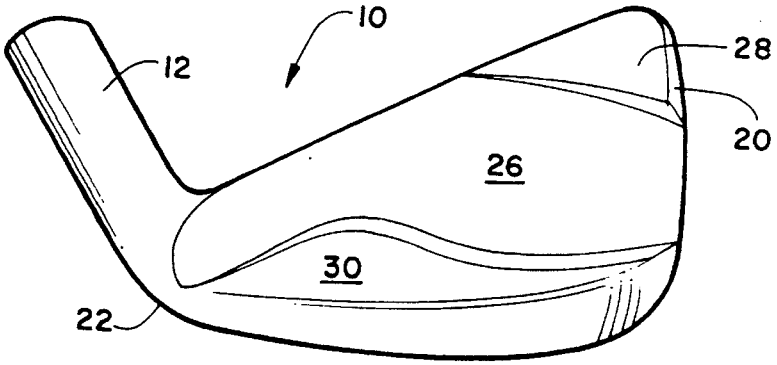
FIG. 6 is a view of the back of a 5 iron, taken normal to the back.
Figure 7:
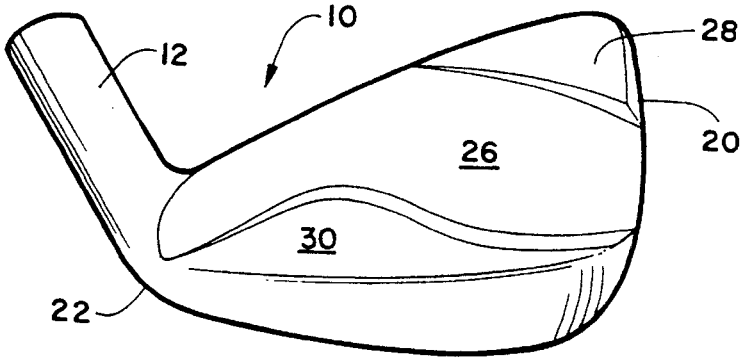
FIG. 7 is a view of the back of an 8 iron, taken normal to the back.
Figure 8:
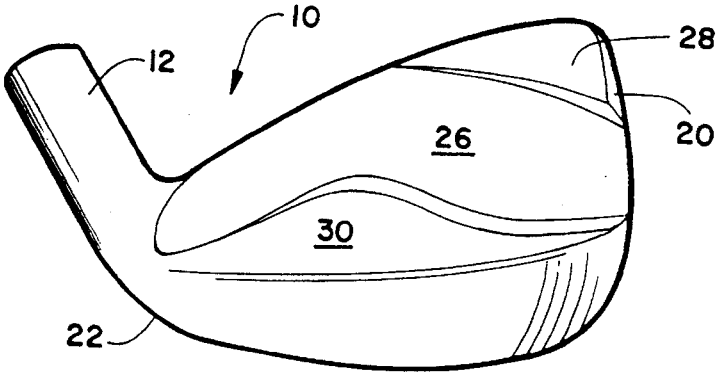
FIG. 8 is a view of the back of a wedge, taken normal to the back.

Referring to FIGS. 1–4, there is seen a golf club head 10 of the type generally called an iron, having a hosel 12 with an axial opening 13 for receiving an end of a conventional golf shaft. As is conventional, low numbered irons have greater shaft lengths and lower loft angles permitting golfers to hit balls further and lower than with higher number irons. Typically, a set of irons runs from 1- or 2-irons through 9-irons, plus specialized pitching wedges, sand wedges, etc.

Basically, the club head shown in FIGS. 1–4 has a face 14 for striking a golf ball, an upper edge 16, a sole edge 18, a toe 20, a heel 22 and a back 24. Back 24 includes a slot 26 of predetermined depth running across the back leaving two raised areas, a toe area 28 and a heel area 30. The toe area 28 is located on a diagonal opposite heel area 30. we have found that when a number of balls are hit by a golf club, the points of impact on club face are found to group in a generally egg-shaped or elliptical area extending along a diagonal line running from the lower heel 22 to the upper toe 20. Toe area 28 and heel area 30 are positioned along this line. This dynamic diagonal balancing of the club head expands the "sweet spot" over which a struck ball will fly in the intended, straight, direction. Since most balls are struck approximately along the weight balancing diagonal, club twist is substantially reduced or eliminated. The particular size and spacing of the thicker, heavier, toe area 28 and heel area 30 can be fine tuned for particular clubs and players to produce optimum results.

While slot 26 may have any suitable shape and depth, in general a substantially uniform depth, with sharp edges as shown, providing a substantially uniform thickness between slot 26 and face 14 is preferred in order to provide the maximum sweet spot along the diagonal and the straightest shots. This diagonal slot eliminates inhibitions present in cavity backed clubs.

Another feature of the invention, as best seem in FIGS. 1–4 and 9–12 is the airfoil cross section of hosel 12, with a rounded portion to one side and a sharp, continuous raised ridge 32 along the other. Raised ridge 32 is aligned with the sole 18 of the club head and with grooves 34 or other lines across club face 14. As the club is in motion on the down swing, the air channel or airstream flows from behind hosel 12 across the front of the hosel and then across the face of the club from heel 22 to toe 20. This air flow pattern continues until just before impact.

With the usual round hosel, turbulent flow occurs on the downstream side of the hosel during most of the swing, resulting in increase drag and less head stability. With the airfoil shaped hosel of this invention, the raised ridge points downstream during most of the swing, causing laminar airflow around the rounded leading side of the hosel and past the raised edge of the downstream trailing side. This results in a head that is more aerodynamically stable and has less drag than conventional heads.

Raised ridge 32 is also helpful to a golfer in aligning the club face when addressing a ball. Ridge 32 will appear as a short bright line. When ridge 32 points directly away from the golfer, at 90° to the intended line of flight, the club face will be aligned square to the ball and the intended line of flight.

Conventionally, the size of club heads become progressively smaller and the shaft becomes longer from low number to high numbered irons. This is directly contrary to the size progression of woods. I have found that the face area of clubs should remain substantially constant despite progressive changes in shaft length and loft. In fact, the heel to toe length of slot back clubs should actually progressively increase as the clubs become longer to provide a longer diagonal sweet spot in the long irons, which are ordinarily more difficult to swing correctly than short irons.

FIGS. 5–8 illustrate this ideal club head length progression. These Figures illustrate several slot back clubs from a progressive set, showing only a 2-iron (FIG. 5), a 5-iron (FIG. 6), a 9-iron (FIG. 8), for clarity and brevity of illustration. These Figures are taken from a point of view normal to the back of the clubs. As can be seen, clubs steadily become shorter from the 2-iron of FIG. 5 to the wedge of FIG. 8. At the same time, the total area remains substantially constant or increases slightly as the head shape progresses from the more straight shape of the 2-iron of FIG. 5 to the more rounded shape of the wedge.

A diagonal line visualized through the centers of mass of the toe area 28 and heel area 30 bounding slot remains substantially constant, although becoming slightly steeper as the head becomes shorter. This conforms to the elliptical area of average ball impact points, which gradually steepens as the clubs become shorter. Thus, the elliptical sweet spot formed by the diagonal club head balance will continue to correspond to the area over which most balls are struck.

Another feature of this invention is illustrated in FIGS. 9–12, which show several slot back clubs from a progressive set, showing only a 2-iron (FIG. 9), a 5-iron (FIG. 10), a 9-iron (FIG. 11), for clarity and brevity of illustration. The club heads are viewed from above, from the position of a golfer addressing a ball, standing to the right of the heads as illustrated.

As discussed above, raised ridge 32 on each hosel always aligns with the face 14 of head 10 and grooves or other lines 34 on the club head face. When the golfer aligns ridge 34 perpendicular to the intended line of flight, the club face is in proper alignment.

Figure 9:
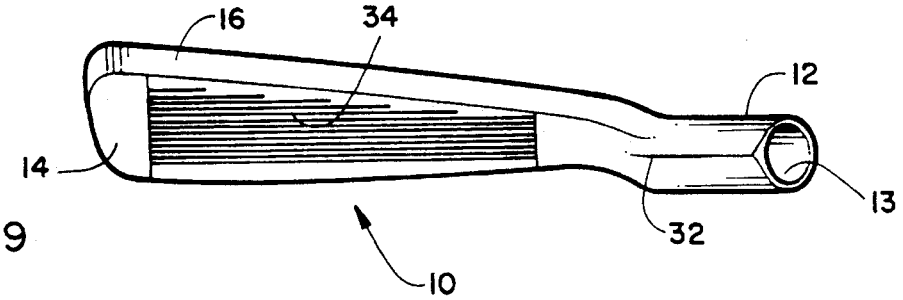
FIG. 9 is a plan view of a 2 iron head.
Figure 10:
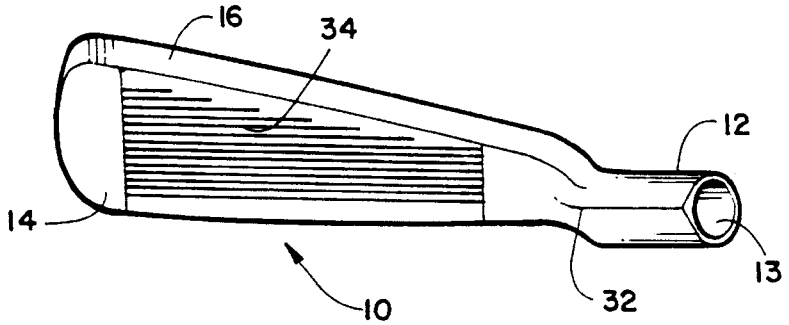
FIG. 10 is a plan view of a 5 iron head.
Figure 11:
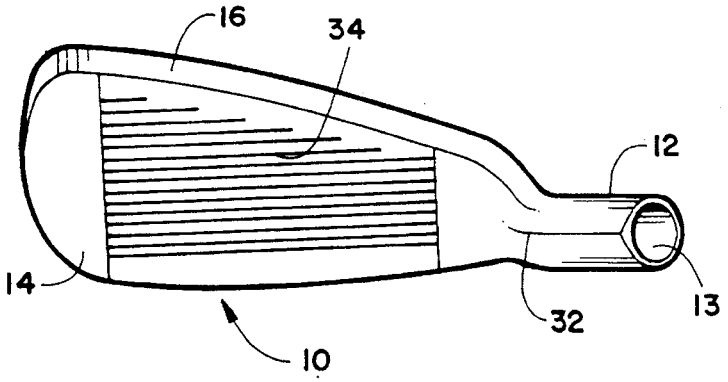
FIG. 11 is a plan view of an 8 iron head.
Figure 12:
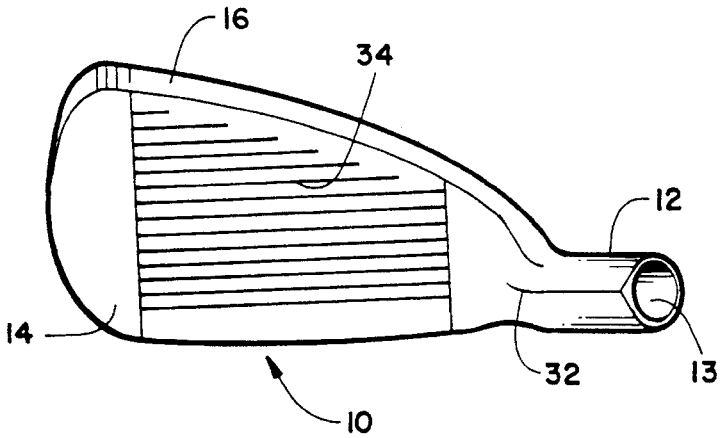
FIG. 12 is a plan view of the head of a wedge.
Figure 13:
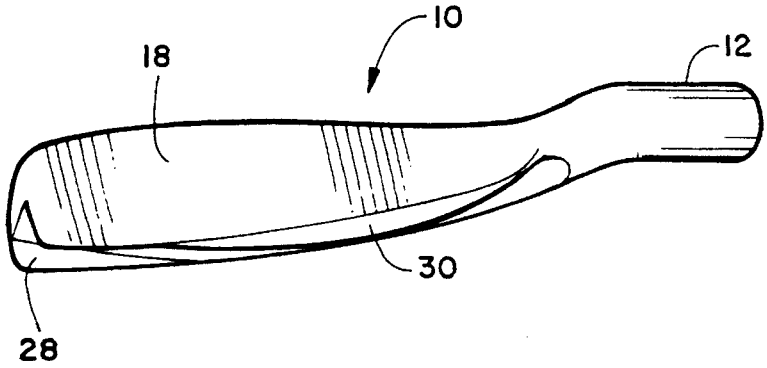
FIG. 13 is a view looking upwardly at the sole of a 2 iron head.
Figure 14:
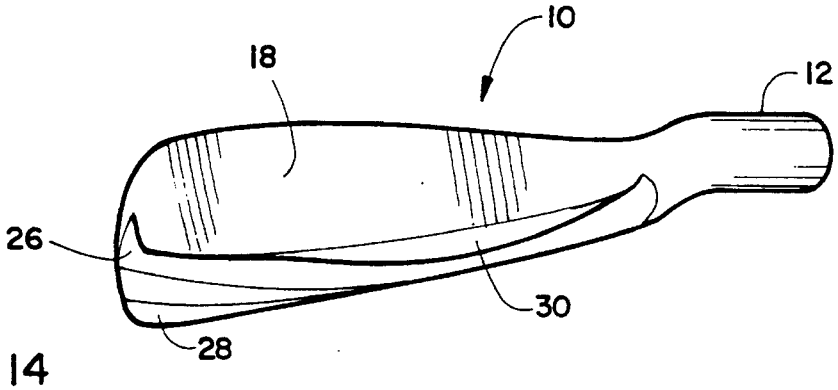
FIG. 14 is a view looking upwardly at the sole of a 5 iron head.
Figure 15:
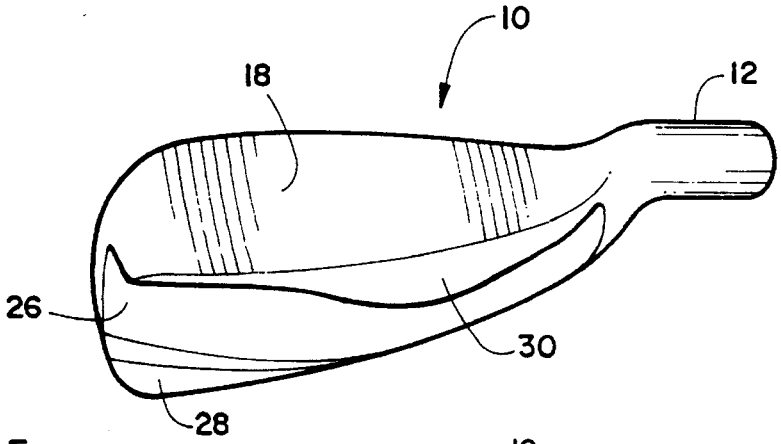
FIG. 15 is a view looking upwardly at the sole of an 8 iron head.

The appearance of each of the clubs is the same except for the changing appearance of face 14 resulting from increased loft going from the 2-iron of FIG. 9 to the wedge of FIG. 12. The upper edge 16 appears to the golfer to have the same width with all clubs, giving a feeling of consistency and reducing the mental stress of seeing a "different" long iron, which many golfers subconsciously fear as being more difficult to hit correctly.

Since upper edge 16 is ordinarily perpendicular to face 14, the angle to vertical of upper edge 16 changes with club loft. Thus, in order to have the same apparent width when seen from above, the actual width of upper edge 16 must progressively increase as loft increases. Thus, the width of upper edge 16 of the wedge seen in FIG. 12 is much greater than that of the 2-iron seen in FIG. 9. This width increase may be easily accomplished by increasing the thickness of the club head along the upper edge or, preferably, by increasing the thickness of the entire club head. This will also cause a desirable progressive increase in weight of heads 10 going from the longer irons to the shorter irons to provide a desired uniformity of swing weight across the different iron lengths. The progression of widths of top edges 16 through a typical set of irons shaped in accordance with this invention is provided in the Table discussed below.

Figure 16:
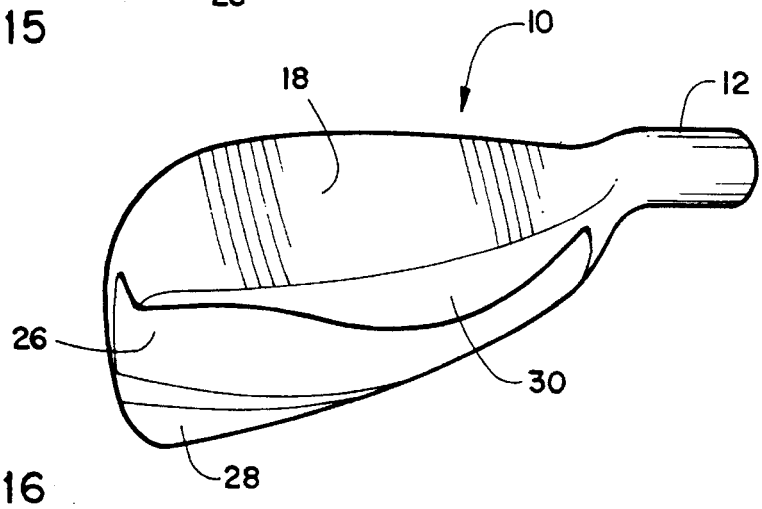
FIG. 16 is a view looking upwardly at the sole of the head of a wedge.

Another preferred feature, a progressive increase in sole width 18 is illustrated in FIGS. 13–16. These Figures illustrate, looking upwardly from below at the sole 18, a 2-iron (FIG. 13), a 5-iron (FIG. 14), a 9-iron (FIG. 15) and a wedge (FIG. 16). A 2-iron is more difficult to hit correctly and take an appropriate divot than are the shorter irons. Therefore, the club of this invention preferably has the narrowest sole 18 with the longest iron, with the sole width progressively increasing as the irons become shorter. I find that the narrow long iron soles tend to concentrate ground friction and improve the chances of taking a suitable divot. With the shorter (high number) irons, the wider sole tends to disperse the ground friction in such a way that the club is prevented from excessively digging into the ground.

The following table provides an example of progressive sizing of a set of clubs, including the heel to toe length, top edge width, base width, lie angle and loft angle. While a 2-iron through wedge are detailed, additional clubs (such as a 1-iron, sand wedge, etc.) will conform to the order of dimension change shown. While the particular dimensions for a particular head design will change, the order of progression will be as shown.

TABLE OF PROGRESSIVE CLUB HEAD MEASUREMENTS

| IRON | LENGTH HEEL-TOE (mm) | TOP EDGE WIDTH (mm) | BASE WIDTH (mm) | LIE ANGLE (Deg.) | LOFT ANGLE (Deg.) |
|---|---|---|---|---|---|
| 2 | 86.30 | 4.57 | 17.57 | 58.0 | 18.0 |
| 3 | 85.23 | 4.65 | 18.35 | 58.9 | 21.0 |
| 4 | 83.84 | 4.75 | 19.15 | 59.8 | 24.0 |
| 5 | 83.12 | 4.83 | 19.92 | 60.6 | 28.0 |
| 6 | 82.13 | 5.13 | 20.76 | 61.5 | 32.0 |
| 7 | 80.79 | 5.38 | 21.73 | 62.4 | 36.0 |
| 8 | 79.90 | 5.66 | 22.61 | 63.3 | 40.0 |
| 9 | 78.50 | 6.05 | 23.60 | 64.1 | 44.0 |
| w | 77.15 | 6.88 | 24.76 | 65.0 | 48.0 |

Other applications, variations and ramifications of this invention will occur to those skilled in the art upon reading this disclosure. Those are intended to be included within the scope of this invention, as defined in the appended claims.

I claim:

1. A set of golf irons comprising:

a plurality of golf irons having progressively increasing shaft lengths and having progressively decreasing loft angles from a shortest iron to a longest iron;

each club comprising a head, a hosel secured to said head at a heel and a shaft connected to said hosel;

each head having a front striking face, a back face, a top edge, a sole, a heel contiguous with said hosel intersecting said sole and heel, and a toe opposite said hosel intersecting said top edge and heel; and each of said back faces having a slot of predetermined depth extending entirely across said back face from a location adjacent to said intersection of said toe and sole to a location adjacent to said intersection of said heel and top edge to provide a slot floor over a thin center region and diagonally spaced thick regions adjacent to said slot, said thick regions located at said intersection of said sole and heel and at said intersection of said top edge and toe;

whereby said head is diagonally balanced.

2. The set of golf irons according to claim 1 wherein each of said slots has a substantially flat floor.

3. The set of golf irons according to claim 2 wherein a wall extends between said slot floor and said thick regions at an angle to said floor of from about 90° to 110°.

4. The set of golf irons according to claim 1 wherein said hosel has an airfoil shaped cross section with a rounded end opposite a pointed end and with said pointed end extending generally in a direction perpendicular to a line of flight taken by a ball impacted by said face.

5. The set of golf irons according to claim 1 wherein the length of said head between said heel and toe becomes progressively longer as said club becomes longer.

6. The set of golf irons according to claim 1 wherein a plurality of spaced grooves extending generally parallel to said sole are formed across a predetermined area of said striking face, said grooves having lengths generally directly proportional to head length.

7. The set of golf irons according to claim 6 wherein the surface area of said front striking face of each of said golf irons is substantially equal.

8. The set of golf irons according to claim 1 wherein said top edge lies substantially perpendicular to said striking face and has a thickness that becomes progressively thinner as said club becomes longer at a rate such that the thickness of succeeding top edges appears to be generally the same from the point of view of a golfer holding any club and addressing a ball.

9. The set of golf irons according to claim 1 wherein said sole of each head progressively varies from narrow at the lowest loft iron to widest at the highest loft iron.

10. A set of golf irons comprising:

a plurality of golf irons having progressively increasing shaft lengths and having progressively decreasing loft angles from a shortest iron to a longest iron;

each club comprising a head, a hosel secured to said head at a heel and a shaft connected to said hosel;

each head having a front striking face, a back face, a top edge, a sole, a heel contiguous with said hosel intersecting said sole and heel, and a toe opposite said hosel intersecting said top edge and heel; and each of said back faces being slotted from a location adjacent to said intersection of said toe and sole to a location adjacent to said intersection of said heel and top edge to provide a substantially flat slot floor extending entirely across said back face over a thin center region connected by walls to diagonally spaced thick regions located at said intersection of said sole and heel and at said intersection of said top edge and toe;

whereby said head is diagonally balanced.

11. The set of golf irons according to claim 10 wherein said walls lie at an angle to said slot floor of from about 90° to 110°.

12. The set of golf irons according to claim 10 wherein said hosel has an airfoil shaped cross section with a rounded end opposite a pointed end and with said pointed end extending generally in a direction perpendicular to a line of flight taken by a ball impacted by said face.

13. The set of golf irons according to claim 12 wherein a plurality of spaced grooves are formed across a predetermined grooved area of said striking face substantially parallel to said sole and in alignment with said pointed end.

14. The set of golf irons according to claim 10 wherein lengths of said head and said grooved area between said heel and toe become progressively longer as said club becomes longer.

15. The set of golf irons according to claim 14 wherein the surface area of said front striking face of each of said golf irons is substantially equal.

16. The set of golf irons according to claim 10 wherein said top edge lies substantially perpendicular to said striking face and has a thickness that becomes progressively thinner as said club becomes longer at a rate such that the thickness of succeeding top edges appears to be generally the same from the point of view of a golfer holding any club and addressing a ball.

17. The set of golf irons according to claim 10 wherein said sole of each head progressively varies from narrow at the lowest loft iron to widest at the highest loft iron.

18. A golf club head for a golf iron comprising:

a hosel having an opening for receiving a golf club shaft;

a blade-like member secured to said hosel and having a front striking face, a back face, a top edge, a sole, a heel contiguous with said hosel intersecting said sole and heel, and a toe opposite said hosel intersecting said top edge and heel; and said back face being slotted from a location adjacent to said intersection of said toe and sole to a location adjacent to said intersection of said heel and top edge to provide a slot floor extending entirely across said back face over a thin center region connected by walls to diagonally spaced thick regions located at said intersection of said sole and heel and at said intersection of said top edge and toe;

whereby said head is diagonally balanced.

19. The golf club head according to claim 18 wherein said floor of said slot is substantially flat.

20. The golf club head according to claim 18 wherein a wall extends between said slot floor and said thick regions at an angle to said floor of from about 90° to 110°.

* * * * *